US007988515B2

(12) United States Patent
Wei et al.

(10) Patent No.: US 7,988,515 B2
(45) Date of Patent: Aug. 2, 2011

(54) METHOD FOR MANUFACTURING FIELD EMISSION ELECTRON SOURCE HAVING CARBON NANOTUBES

(75) Inventors: Yang Wei, Bei-Jing (CN); Liang Liu, Bei-Jing (CN); Shou-Shan Fan, Bei-Jing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 427 days.

(21) Appl. No.: 12/006,305

(22) Filed: Dec. 29, 2007

(65) Prior Publication Data

US 2009/0117674 A1 May 7, 2009

(30) Foreign Application Priority Data

Nov. 2, 2007 (CN) ..... 2007 1 0124241

(51) Int. Cl.
*H01J 9/00* (2006.01)
*H01J 9/04* (2006.01)

(52) U.S. Cl. ..... 445/50; 445/49; 445/51

(58) Field of Classification Search ..... 445/49, 445/50, 51
See application file for complete search history.

(56) References Cited

U.S. PATENT DOCUMENTS

| | | | | |
|---|---|---|---|---|
| 7,586,249 | B2 | 9/2009 | Jiang et al. | |
| 7,704,480 | B2 * | 4/2010 | Jiang et al. | 423/447.2 |
| 2003/0186625 | A1 * | 10/2003 | Nakayama et al. | 451/28 |
| 2004/0095050 | A1 | 5/2004 | Liu et al. | |
| 2007/0145878 | A1 | 6/2007 | Liu et al. | |
| 2007/0166223 | A1 | 7/2007 | Jiang et al. | |
| 2008/0170982 | A1 | 7/2008 | Zhang et al. | |
| 2009/0239439 | A1 | 9/2009 | Wei et al. | |

FOREIGN PATENT DOCUMENTS

| | | | |
|---|---|---|---|
| CN | 1501422 | A | 6/2004 |
| CN | 1688011 | A | 10/2005 |
| CN | 1941249 | A | 4/2007 |
| CN | 1982209 | A | 6/2007 |
| CN | 1988108 | A | 6/2007 |
| CN | 101007366 | A | 8/2007 |
| JP | 2003502798 | | 1/2003 |
| JP | 2004303521 | | 10/2004 |
| WO | WO0077813 | | 12/2000 |
| WO | WO2007015710 | | 2/2007 |
| WO | WO 2007015710 | A2 * | 2/2007 |

* cited by examiner

*Primary Examiner* — Nimeshkumar D Patel
*Assistant Examiner* — Anthony T Perry
(74) *Attorney, Agent, or Firm* — Jeffrey T. Knapp

(57) ABSTRACT

A method for manufacturing a field emission electron source includes: providing a CNT array; drawing a bundle of CNTs from the CNT array to form a CNT yarn; soaking the CNT yarn into an organic solvent, and shrinking the CNT yarn into a CNT string after the organic solvent volatilizing; applying a voltage between two opposite ends of the CNT string, until the CNT string snapping at a certain point; and attaching the snapped CNT string to a conductive base, and achieving a field emission electron source. The field emission efficiency of the field emission electron source is high.

20 Claims, 9 Drawing Sheets

METHOD FOR MANUFACTURING FIELD EMISSION ELECTRON SOURCE HAVING CARBON NANOTUBES

RELATED APPLICATIONS

This application is related to commonly-assigned, co-pending application: U.S. patent application Ser. No. 12/006,335, entitled "METHOD FOR MANUFACTURING FIELD EMISSION ELECTRON SOURCE HAVING CARBON NANOTUBE", filed on Dec. 29, 2007 and U.S. patent application Ser. No. 12/006,334, entitled "FIELD EMISSION ELECTRON SOURCE HAVING CARBON NANOTUBES AND METHOD FOR MANUFACTURING THE SAME", filed on Dec. 29, 2007. The disclosure of the respective above-identified application is incorporated herein by reference.

BACKGROUND

1. Field of the Invention

The invention relates to methods for manufacturing field emission electron sources and, particularly, to a method for manufacturing a field emission electron source employing carbon nanotubes.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for field emission electron sources.

Generally, a field emission electron source having CNTs includes a conductive base and CNTs formed on the conductive base. The CNTs acts as emitter of the field emission electron source. The methods adopted for forming the CNTs on the conductive base mainly include mechanical methods and in-situ synthesis methods. The mechanical method is performed by respectively placing single CNT on a conductive base by an Atomic force microscope (AFM), then fixing CNT on the conductive base by conductive pastes or adhesives. However, the controllability of the mechanical method is less than desired, because single CNT is so tiny in size.

The in-situ synthesis method is performed by coating metal catalysts on a conductive base and synthesizing CNTs on the conductive base directly by means of chemical vapor deposition (CVD). However, the mechanical connection between the CNTs and the conductive base often is relatively weak and thus unreliable. In factual use, such CNTs are easy to be drawn away from the conductive base due to the electric field force, which would damage the field emission electron source and/or decrease its performance. Furthermore, the shield effect between the adjacent CNTs may reduce the field emission efficiency thereof.

What is needed, therefore, is a controllable method for manufacturing a field emission source employing CNTs, which has a firm mechanical connection between CNTs and the conductive base, and has a high field emission efficiency.

SUMMARY

A method for manufacturing a field emission electron source includes: providing a CNT array; drawing a bundle of CNTs from the CNT array to form a CNT yarn; soaking the CNT yarn into an organic solvent, and shrinking the CNT yarn into a CNT string after the organic solvent volatilizing; applying a voltage between two opposite ends of the CNT string, until the CNT string snapping at a certain point; and attaching the snapped CNT string to a conductive base, and achieving a field emission electron source.

Compared with the conventional method, the present method has the following advantages: firstly, a CNT string, which is in a larger scale than the CNT, is used as the electron emitter, and thus the present method is more controllable. Secondly, the CNT string is attached to the conductive base by a conductive paste, and thus the connection is firm. Thirdly, the break-end portion of the CNT string is in a tooth-shape structure, which can prevent the shield effect caused by the adjacent CNTs. Further, the electric and thermal conductivity, and mechanical strength of the CNT string are improved in the above process. Therefore, the field emission efficiency of the field emission electron source is improved.

Other advantages and novel features of the present ion source element will become more apparent from the following detailed description of preferred embodiments when taken in conjunction with the accompanying drawings.

BRIEF DESCRIPTION OF THE DRAWINGS

Many aspects of the present method can be better understood with reference to the following drawings. The components in the drawings are not necessarily to scale, the emphasis instead being placed upon clearly illustrating the principles of the present method.

Figure 1:
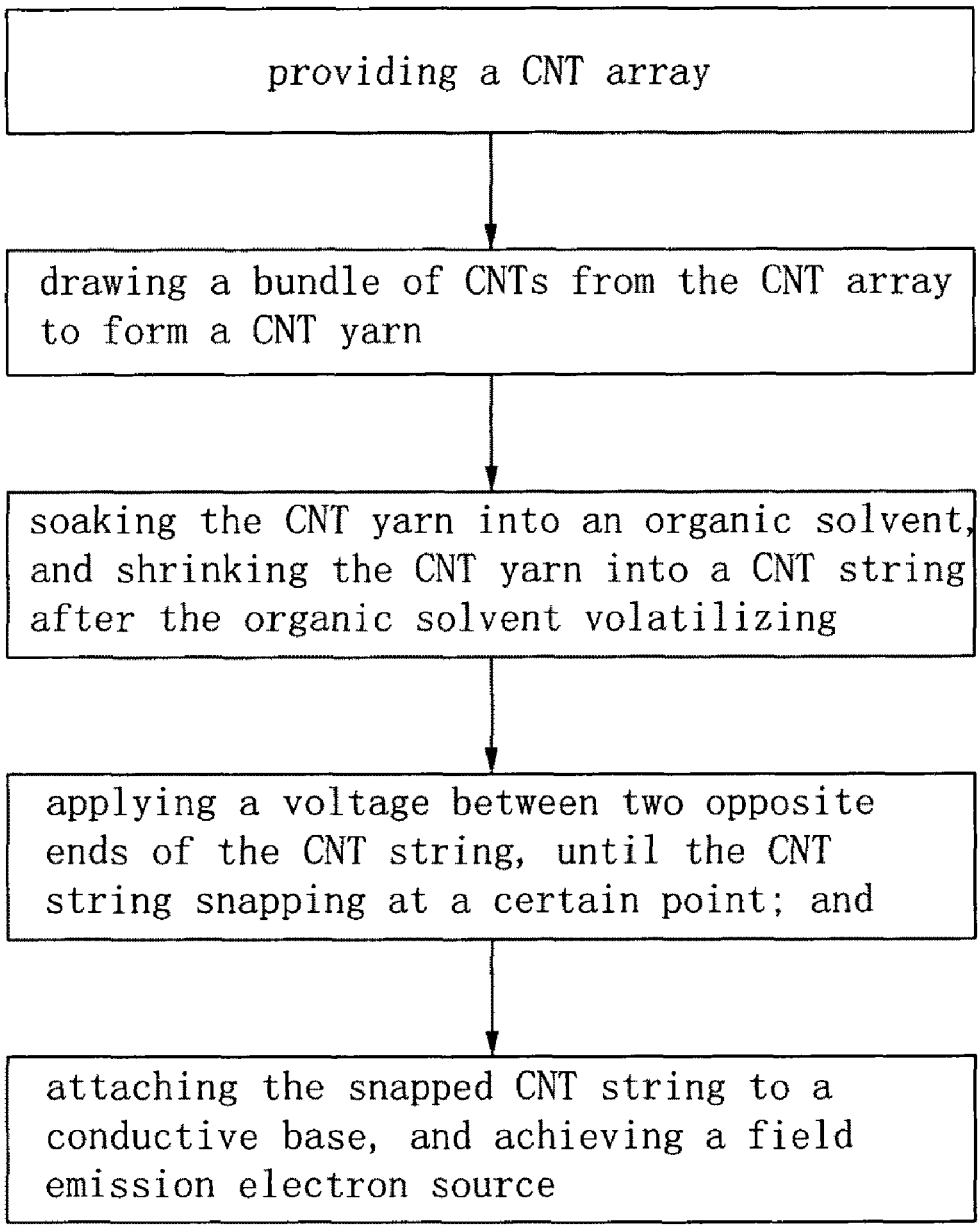
FIG. 1 is a process flow chart showing the steps of the present method.

Corresponding reference characters indicate corresponding parts throughout the several views. The exemplifications set out herein illustrate at least one preferred embodiment of the present method, in one form, and such exemplifications are not to be construed as limiting the scope of the invention in any manner.

DETAILED DESCRIPTION OF PREFERRED EMBODIMENTS

Reference will now be made to the drawings to describe the preferred embodiments of the present method, in detail.

Referring to FIG. 1, a method for manufacturing a field emission electron source is illustrated as following steps:

Step 1, providing a CNT array;

Step 2, drawing a bundle of CNTs from the CNT array to form a CNT yarn;

Step 3, soaking the CNT yarn in an organic solvent, and shrinking the CNT yarn into a CNT string after the organic solvent volatilizing;

Step 4, applying a voltage between two opposite ends of the CNT string, until the CNT string snaps at a certain point; and Step 5, attaching the snapped CNT string to a conductive base, and achieving a field emission electron source.

In step 1, the CNT array is a super-aligned CNT array, which is grown using a chemical vapor deposition method. The method is described in U.S. Pat. No. 7,045,108, which is incorporated herein by reference. Firstly, a substrate is provided, and the substrate can be p type silicon or n type silicon substrate. Secondly, a catalyst layer is deposited on the substrate. The catalyst layer is made of a material selected from a group consisting of iron (Fe), cobalt (Co), nickel (Ni), and their alloys. Thirdly, the substrate with the catalyst layer is annealed at a temperature in an approximate range from 300 to 400 degrees centigrade under a protecting gas for about 10 hours. Fourthly, the substrate with the catalyst layer is heated to approximately 500 to 700 degrees centigrade and a mixed gas including a carbon containing gas and a protecting gas is introduced for about 5 to 30 minutes to grow a super-aligned CNTs array. The carbon containing gas can be a hydrocarbon gas, such as acetylene or ethane. The protecting gas can be an inert gas. The grown CNTs are aligned parallel in columns and held together by van der Waals force interactions. The CNTs array has a high density and each one of the CNTs has an essentially uniform diameter.

In step 2, a CNT yarn may be obtained by drawing a bundle of the CNTs from the super-aligned CNTs array. Firstly, a bundle of the CNTs including at least one CNT are selected. Secondly, the bundle of the CNTs is drawn out using forceps or adhesive tap, to form a CNT yarn along the drawn direction. The bundles of the CNTs are connected together by van der Waals force interactions to form a continuous CNT yarn. Further, the CNT yarn can be treated by a conventional spinning process, and a CNT yarn in a twist shape is achieved.

In step 3, the CNT yarn is soaked in an organic solvent. The step is described in U.S. Pat. Pub. No. 2007/0166223, which is incorporated herein by reference. Since the untreated CNT yarn is composed of a number of the CNTs, the untreated CNT yarn has a high surface area to volume ratio and thus may easily become stuck to other objects. During the surface treatment, the CNT yarn is shrunk into a CNT string after the organic solvent volatilizing, due to factors such as surface tension. The surface area to volume ratio and diameter of the treated CNT string is reduced. Accordingly, the stickiness of the CNT yarn is lowered or eliminated, and strength and toughness of the CNT string is improved. The organic solvent may be a volatilizable organic solvent, such as ethanol, methanol, acetone, dichloroethane, chloroform, and any combination thereof.

Figure 2:
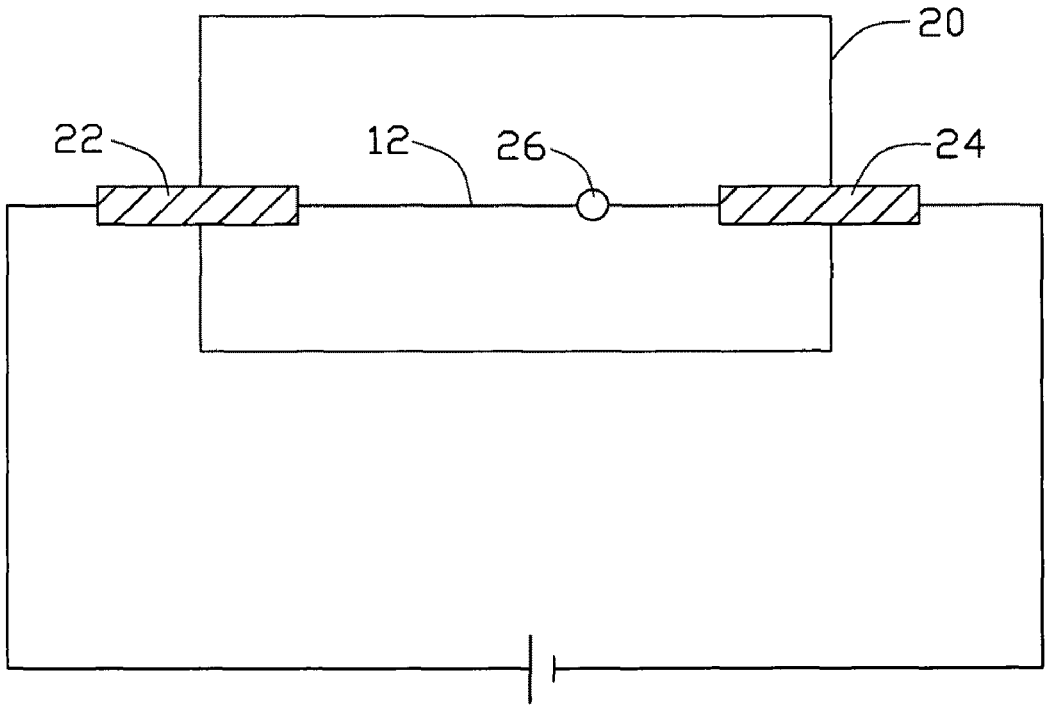
FIG. 2 is a schematic view, showing a carbon nanotube string fused under a fusing current.
Figure 3:
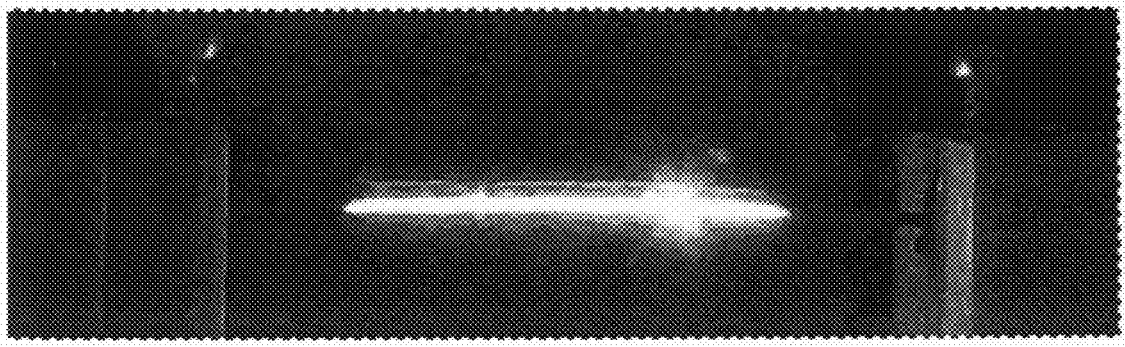
FIG. 3 is a photo, showing a carbon nanotube string fused under a fusing current.

Referring to FIGS. 2 and 3, the step 4 includes the following sub-steps:

In sub-step (1), the CNT string is placed in a chamber. The chamber may be a vacuum or filled with an inert gas. A diameter of the CNT string is in an approximate range from 1 to 100 microns (μm), and a length thereof is in an approximate range from 0.1-10 centimeters (cm). In the present embodiment, the vacuum chamber 20 includes an anode 22 and a cathode 24, which lead (i.e., run) from inside to outside thereof. Two opposite ends of CNT string 12 are attached to and electrically connected to the anode 22 and the cathode 24, respectively.

In sub-step (2), a voltage is applied between the anode and the cathode to heat the CNT string, to apply a voltage on two opposite ends of the CNT string. The voltage is determinated according to a diameter and/or a length of the CNT yarn. In the present embodiment, the CNT yarn 12 is 2 cm in the length and 25 μm in the diameter, and then a 40 voltage (V) DC dias is applied between the anode 22 and the cathode 24 to heat the CNT yarn 12, under a vacuum of less than $2\times10^{-5}$ Pascal (Pa), beneficially, $2\times10^{-5}$ Pa.

In sub-step (3), after a while, the CNT string is snapped at a certain point along the long axial thereof, and two snapped CNT strings respectively having break-end are formed. When the voltage is applied to the CNT string, a current flows through the CNT string. Consequently, the CNT string is heated by Joule-heating, and a temperature of the CNT string 12 can reach an approximate range from 2000 to 2400 Kelvin (K). The resistance at the points distributing along the long axial of the CNT string 12 is different, and thus the temperature distributing along the long axial of the CNT string 12 is different. The greater the resistance and higher the temperature, the more easily snapping. In the present embodiment, after less than 1 hour (h), the CNT string 12 is snapped at the point 26.

Figure 4:
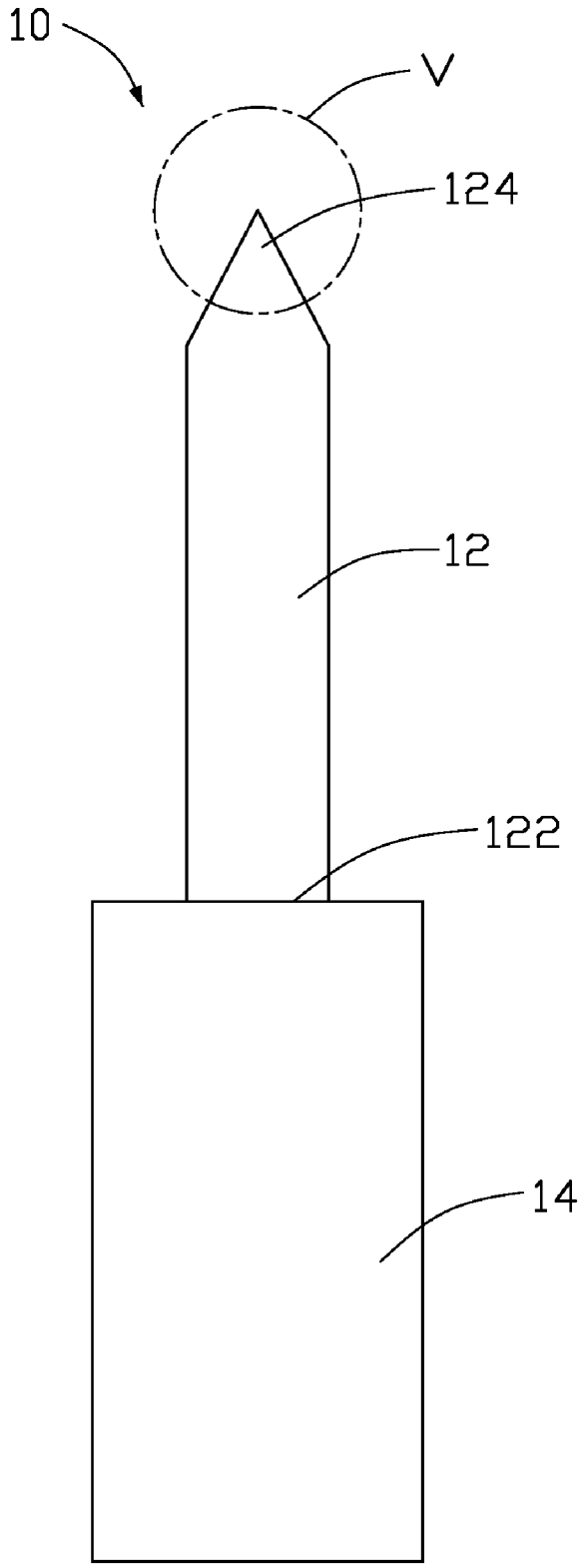
FIG. 4 is a schematic view, showing a field emission electron source manufactured by the present method.
Figure 5:
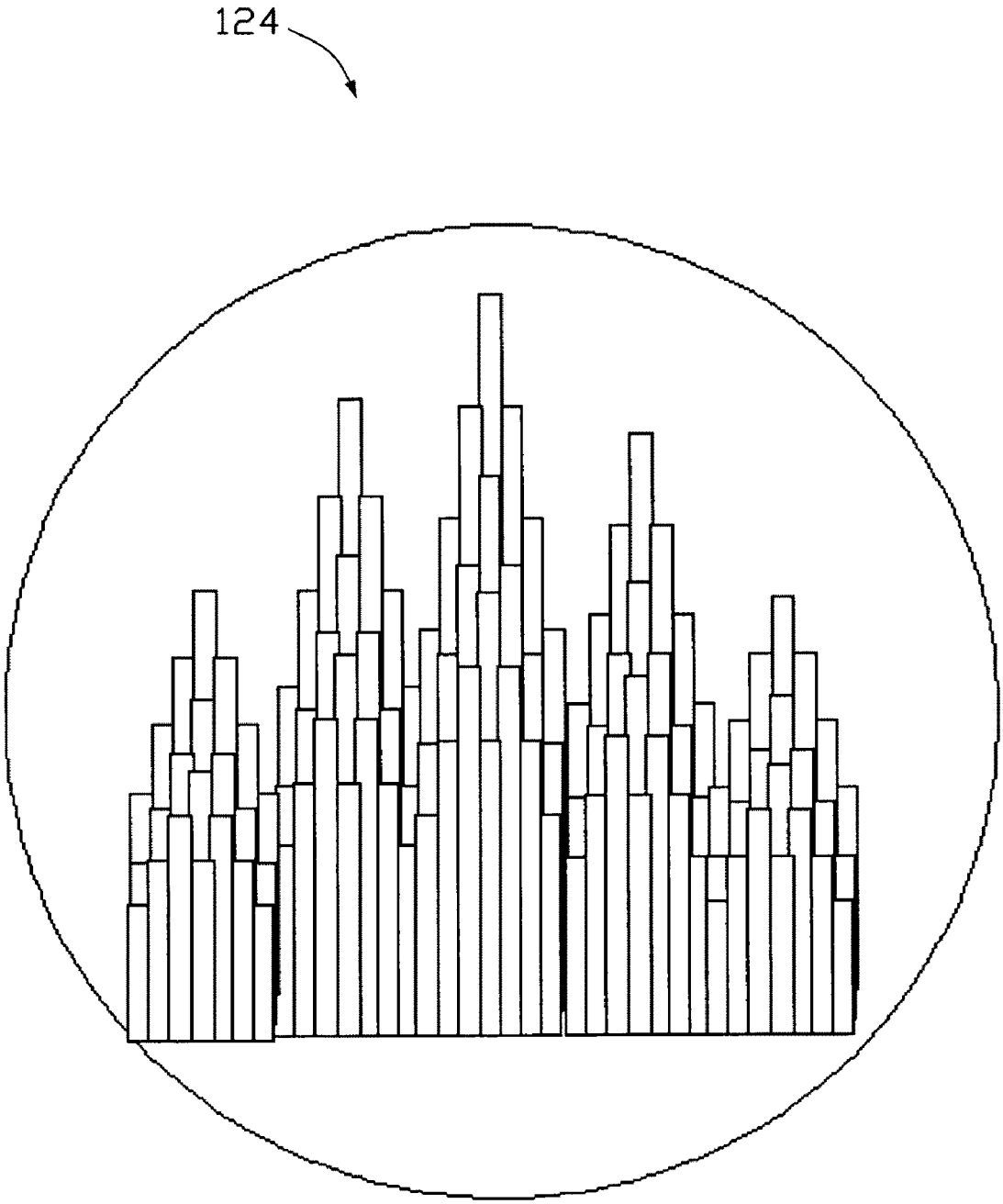
FIG. 5 is a schematic, amplificatory view of V in FIG. 4.
Figure 6:
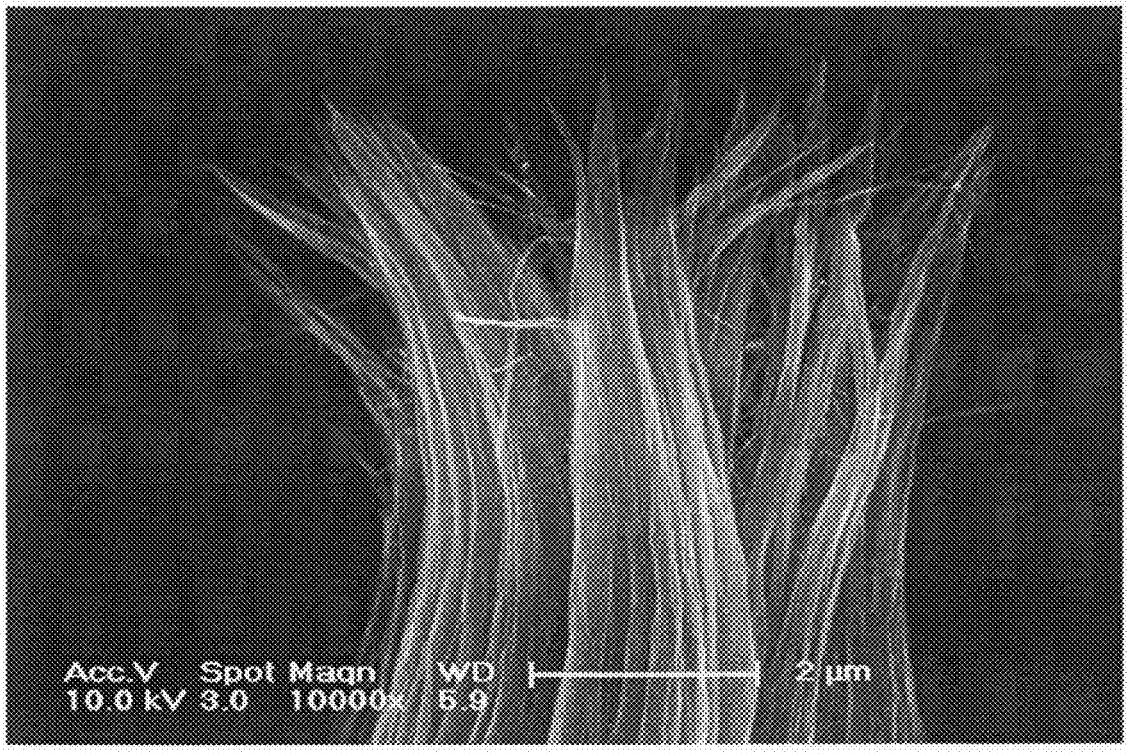
FIG. 6 is a Scanning Electron Microscope (SEM) photo, showing an emission tip of the field emission electron source manufactured by the present method.
Figure 7:
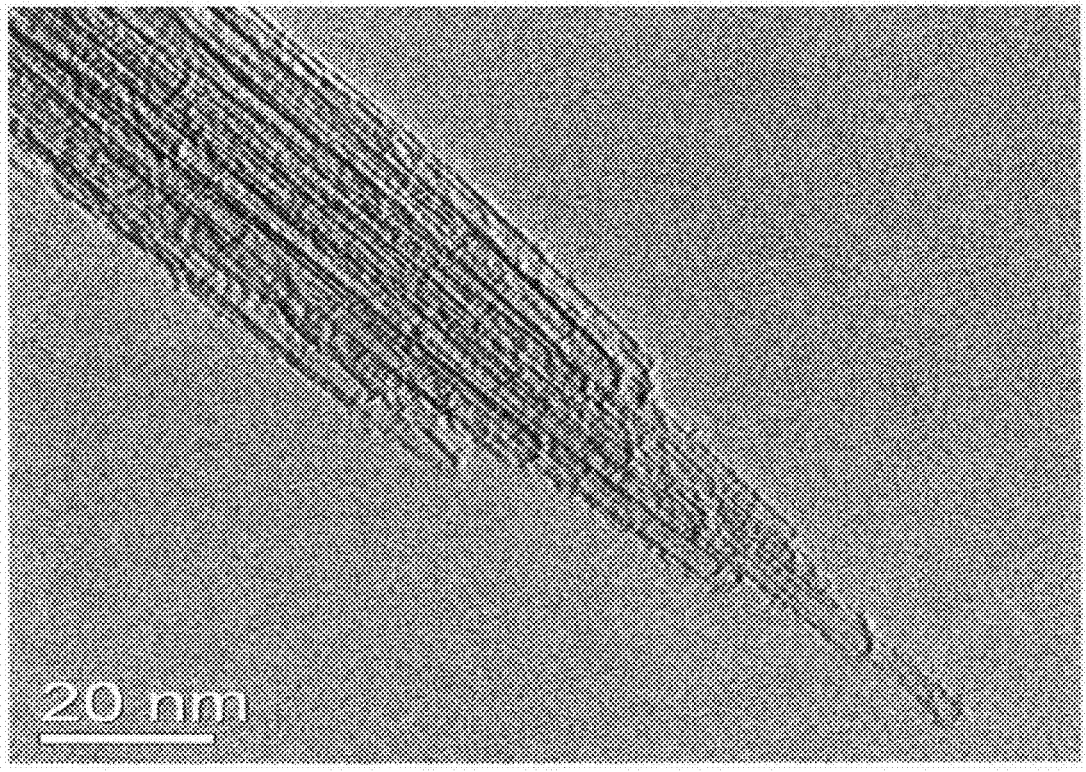
FIG. 7 is a Transmission Electron Microscope (TEM) photo, showing an emission tip of the field emission electron source manufactured by the present method.

Referring to FIG. 4, each snapped CNT string 12 has an end portion 122 and a break-end portion 124 opposite to the end portion 122. The CNT string 12 is composed of well-aligned and firmly compacted CNTs. Referring to FIGS. 5, 6 and 7, the break-end portion 124 with different height of CNTs form a tooth-shaped structure, i.e., some CNTs protruding and higher than the adjacent CNTs, wherein each protruding CNT can be used as an electron emitter. That is because that during snapping, some carbon atoms vaporizes from the CNT string 12. After snapping, a micro-fissure (not labeled) is formed between two break-end portions 124, the arc discharge may occur between the micro-fissure, and then the carbon atoms are transformed into the carbon ions due to ionization. These carbon ions bombard/etch the break-end portions 124, and then the break-end portion 124 form the tooth-shaped structure.

Figure 8:
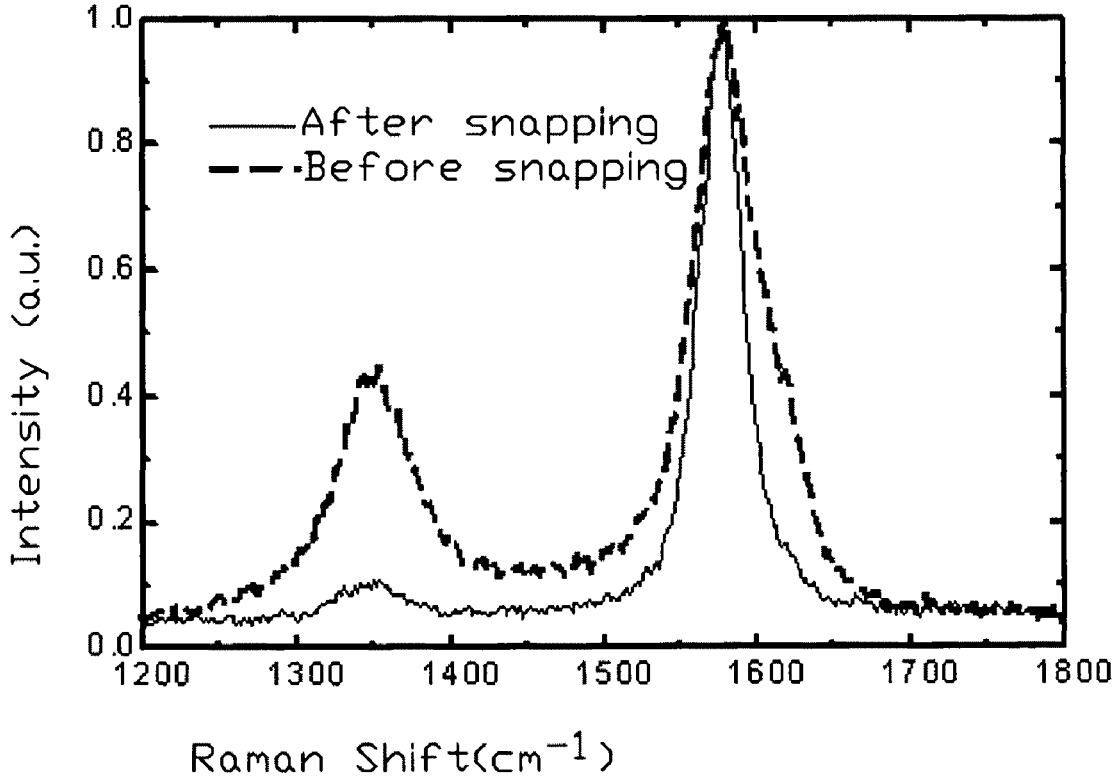
FIG. 8 is a Raman spectrum of the emission tip of the field emission electron source manufactured by the present method.

The CNTs at the break-end portion 124 have smaller diameter and fewer number of graphite layer, typically, less than 5 nanometer (nm) in diameter and about 2-3 in wall. However, the CNTs in the CNT string other than the break-end portion 124 are about 15 nm in diameter and more than 5 in wall. It can be concluded that the diameter and the number of the graphite layers of the CNTs are decreased in a vacuum breakdown process. A wall by wall breakdown of CNTs is due to Joule-heating at a temperature higher than 2000K, with a current decrease process. The high-temperature process can efficiently remove the defects in CNTs, and consequently improve electric and thermal conductivity, and mechanical strength thereof. FIG. 8 shows a Raman spectrum of the break-end portion 124. After snapping, the intensity of D-band (defect mode) at 1350 $cm^{-1}$ is reduced, which indicates the structure effects at the break-end portion 124 are effectively removed.

The CNT string has improved field emission efficiency, because of good electric and thermal conductivity, and mechanical strength. Moreover, the break-end portion is in the tooth-shaped structure, which can prevent the shield effect caused by the adjacent CNTs, consequently, the field emission efficiency of the CNT string can be further improved.

In step 5, the snapped CNT string is electrically connected to conductive base. In the present embodiment, the end portion 122 of the CNT string 12 is attached to/electrically connected with a conductive base 14 by silver paste, the break-end portion 124 is a free end, which used as the electron emitters, and then a field emission electron source 10 is formed. The conductive base is made of an electrically conductive material, such as nickel, copper, tungsten, gold, molybdenum or platinum, or an insulated base with a conductive film formed thereon.

Figure 9:
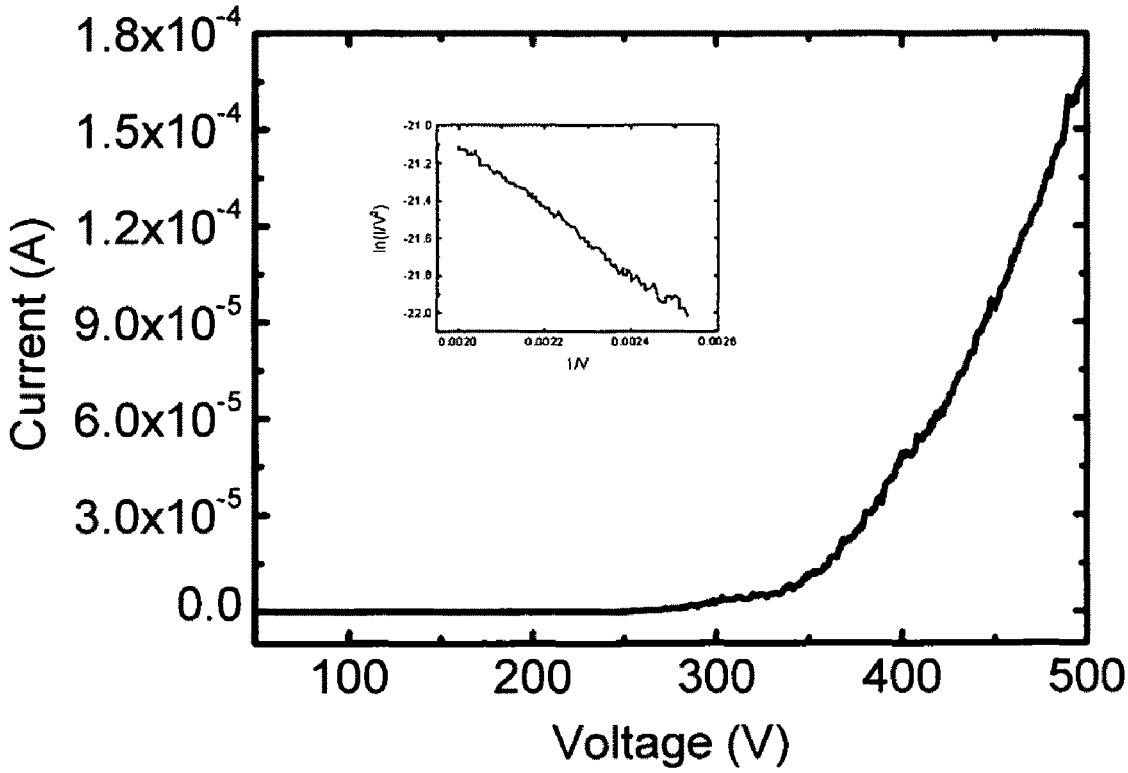
FIG. 9 a current-voltage graph of the field emission electron source manufactured by the present method.

FIG. 9 shows an I-V graph of the present field emission electron source 10. A threshold voltage thereof is about 250 V, and an emission current thereof is over 150 μA. The diameter of the break-end portion is about 5 μm, and thus a current density can be calculated over 700 A/cm$^2$. The inset of FIG. 9 shows a Fowler-Nordheim (FN) plot, wherein the straight line ($\ln(I/V^2)$ via 1/V) indicate a typical field emission efficiency of the field emission electron source.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for manufacturing a field emission electron source comprising:

providing a CNT array;

drawing a bundle of CNTs from the CNT array to form a CNT yarn;

soaking the CNT yarn into an organic solvent, and shrinking the CNT yarn into a CNT string after the organic solvent volatilizing;

applying a voltage between two opposite ends of the CNT string, until the CNT string snaps at a certain point to form two CNT string emitters, wherein each of the two CNT string emitters comprises an end portion and a break-end portion opposite to the end portion, the break-end portion comprises a plurality of CNT bundles, each of the plurality of CNT bundles has a taper shaped end comprising a plurality of CNTs, and some CNTs protrude higher than other adjacent CNTs; and attaching the end portion of at least one of the two CNT string emitters to a conductive base.

2. The method as claimed in claim 1, wherein the CNT array is a super-aligned CNT array.

3. The method as claimed in claim 1, wherein the CNT yarn comprises a plurality of CNTs, and the CNTs are closely attached to each other by van der Waals attractive force.

4. The method as claimed in claim 1, wherein the voltage is determined by a diameter and a length of the CNT string.

5. The method as claimed in claim 4, wherein the diameter of the CNT string is in an approximately range from 1 micron to 100 microns.

6. The method as claimed in claim 4, wherein the length of the CNT string is in an approximately range from 0.1 centimeters to 10 centimeters.

7. The method as claimed in claim 4, wherein the voltage is about 40 voltages.

8. The method as claimed in claim 1, wherein the break-end portion comprises a plurality of CNTs, a diameter of each of the plurality of CNTs is less than 5 nanometers, and each of the plurality of CNTs is composed of two or three graphite layers.

9. The method as claimed in claim 1, wherein the end portion is attached to the conductive base by a silver paste.

10. The method as claimed in claim 1, wherein after being applied a voltage, a temperature of the CNT string reaches an approximate range from 2000 to 2400 kelvins.

11. The method as claimed in claim 1, wherein the conductive base is composed of a conductive material or an insulated base with a conductive film formed on the insulated base.

12. The method as claimed in claim 1, wherein a threshold voltage of the field emission electron source is about 250 voltages, and an emission current of the field emission electron source is more than 150 microamperes.

13. The method as claimed in claim 1, wherein within one hour of the voltage being applied the CNT string is snapped.

14. The method as claimed in claim 1, wherein single CNT of the plurality of CNTs is taller than and projects over other CNTs.

15. The method as claimed in claim 14, wherein the single CNT is located in the middle of the other CNTs.

16. The method as claimed in claim 1, wherein a micro-fissure is formed between two break-end portions after the CNT string is snapped, an arc discharge occurring between the micro-fissure transforming carbon atoms of the break-end portion into carbon ions.

17. The method as claimed in claim 16, the carbon ions bombard the break-end portion and form the toothed shaped structure.

18. A method for manufacturing a field emission electron source, the method comprising:

providing a CNT string comprising a plurality of CNTs attached to each other by van der Waals attractive force;

applying a voltage between two opposite ends of the CNT string until the CNT string snaps at a certain point to form two CNT string emitters, wherein each of the CNT string emitters comprises an end portion and a break-end portion opposite to the end portion, the break-end portion comprises a plurality of CNT bundles, each of the plurality of CNT bundles has a taper shaped end comprising a plurality of CNTs, and some CNTs protrude higher than other adjacent CNTs; and attaching the end portion of at least one of the two CNT string emitters to a conductive base.

19. The method as claimed in claim 18, wherein a single CNT of the plurality of CNTs is taller than and projects over other CNTs.

20. The method as claimed in claim 19, wherein the single CNT is located in the middle of the other CNTs.

* * * * *